US006667141B2

(12) United States Patent
Iwamoto et al.

(10) Patent No.: US 6,667,141 B2
(45) **Date of Patent: *Dec. 23, 2003**

(54) IMAGE FORMING METHOD AND APPARATUS

(75) Inventors: Yasuaki Iwamoto, Numazu (JP); Fumihiro Sasaki, Fuji (JP); Hiroaki Matsuda, Numazu (JP); Hiroshi Nakai, Yokohama (JP); Hiroto Higuchi, Numazu (JP); Bing Shu, Mishima (JP); Maiko Kondo, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/077,752

(22) Filed: Feb. 20, 2002

(65) Prior Publication Data

US 2002/0155368 A1 Oct. 24, 2002

(30) Foreign Application Priority Data

Feb. 20, 2001 (JP) ..... 2001-043587

(51) Int. Cl.[7] ..... G03G 13/16

(52) U.S. Cl. ..... 430/111.4; 430/109.4; 430/124; 399/176

(58) Field of Search ..... 430/124, 111.4, 430/109.3, 109.4; 399/174, 176

(56) References Cited

U.S. PATENT DOCUMENTS 6,052,549 A * 4/2000 Shimura et al. ..... 399/176
6,074,795 A 6/2000 Watanabe et al. ..... 430/106.6
6,103,441 A 8/2000 Tomita et al. ..... 430/110
6,168,894 B1 1/2001 Aoki et al. ..... 430/99
6,180,298 B1 1/2001 Kuroda et al. ..... 430/45
6,263,175 B1 * 7/2001 Sawada et al. ..... 399/100
6,335,137 B1 1/2002 Suzuki et al. ..... 430/110.1
6,337,957 B1 1/2002 Tamaki et al.
6,360,068 B1 3/2002 Kinoshita et al. ..... 399/284
6,363,229 B1 3/2002 Shiraishi et al. ..... 399/68
6,395,443 B2 5/2002 Kuroda et al. ..... 430/110.4
6,403,275 B1 6/2002 Kuramoto et al. ..... 430/111.4
6,406,826 B1 6/2002 Suzuki et al. ..... 430/111.35
6,432,589 B1 8/2002 Uchinokura et al. ..... 430/18
6,442,364 B2 8/2002 Kai et al.
6,468,706 B2 10/2002 Matsuda et al. ..... 430/108.6
6,505,014 B2 1/2003 Aoki et al.
6,507,718 B2 1/2003 Ohjimi et al.

FOREIGN PATENT DOCUMENTS

JP 2000-356865 12/2000
JP 2001-043587 2/2001

* cited by examiner

*Primary Examiner*—John Goodrow
(74) *Attorney, Agent, or Firm*—Oblon, Spivak, McClelland, Maier & Neustadt, P.C.

(57) ABSTRACT

An image forming method and apparatus, wherein a surface of a photoconductor is charged with a contact-type charging roller having a surface roughness of 2–40 $\mu$m, and exposed imagewise to form an electrostatic latent image thereon, the latent image being developed with a toner, transferred to a transfer member and fixed, and wherein the toner comprises a colorant, and a binder resin containing a tetrahydrofuran-soluble component having such a molecular weight distribution that at least one peak having a half width not greater than 15,000 is present between 1,000 and 10,000 when measured by gel permeation chromatography.

19 Claims, 1 Drawing Sheet

IMAGE FORMING METHOD AND APPARATUS

BACKGROUND OF THE INVENTION

1. Field of the Invention

This invention relates to an image forming method by electrophotography, electrostatic recording or electrostatic printing, and to an image forming apparatus for carrying out the above method. The present invention is also directed to an electrophotographic toner for use in the above method and apparatus.

2. Discussion of the Prior Art

Various electrophotographic image forming methods have been disclosed in U.S. Pat. No. 2,297,691, Japanese Patent Publications Nos. 42-23910 and 43-24748. The methods typically include the following processes: (a) a surface of a photoconductor is charged (charging process); (b) the charged surface is exposed to light to form an electrostatic latent image thereon (latent image forming process); (c) the latent image is developed with an electrophotographic toner to form a toner image on the photoconductor (developing process); (d) the toner image is transferred directly or indirectly through an intermediate transfer member onto a transfer member such as paper (transferring process); and (e) the toner image is fixed upon application of heat, pressure, solvent vapor, or combination thereof (fixing process). A cleaning process is generally adopted to remove toner remaining on the photoconductor after the image transferring process.

As the method for developing electrostatic latent images, there are known a magnetic brush method (U.S. Pat. No. 2,874,063), a cascade method (U.S. Pat. No. 2,618,552), a powder cloud method (U.S. Pat. No. 2,221,776) and a method using a conductive magnetic toner (U.S. Pat. No. 3,909,258). A toner for use in these method generally includes a colorant, such as a pigment or a dye, and a binder resin. A magnetic particle such as magnetite is incorporated in the toner for forming a magnetic toner. The toner may be used as such as a single component developer or may be used in conjunction with a carrier, such as glass beads or iron powder, as a two-component developer.

In recent years, the above-mentioned image forming method is utilized not only in copying machines but also in output devices for computers and fixation of microfilms. Thus, there are increasing demands for image forming methods which can simultaneously satisfy many requirements such as a small size, a low cost, a light-weight, low energy consumption, maintenance-freedom and personal use. Accordingly, a toner for use in such image forming methods must meet with various performances. For example, in addition to safety, toner must not generate odors during fixation. While the problem of generation of odors may be reduced by mounting a filter to image forming apparatuses, it is necessary to periodically replace the filter with new one.

Generation of ozone during charging process is also one of the problems involved in the image forming method. Thus, a contact-type charging method using a charging roller is being substituted for a corona discharge method. While the contact-type charging method is free of ozone generation, a toner which has remained unremoved from a photoconductor is apt to deposit to a surface of the charging roller so that charging failure is caused. Such toner deposition is accelerated when the toner having a small particle diameter is used for obtaining fine, clear images.

To cope with the toner deposition problem in the charging roller, Japanese patent No. 2814211 proposes a toner having a benzaldehyde content of 0.005% by weight and containing a binder resin having such a molecular weight distribution that a Mw/Mn (weight average molecular weight/number average molecular weight) ratio is 5 or more and that 10–50% by weight of the binder resin has a molecular weight of 10,000 or less. The known toner, however, is still not fully satisfactory with respect to the prevention of fouling of the charging roller.

SUMMARY OF THE INVENTION

It is, therefore, an object of the present invention to provide an image forming method in which charging of a photoconductor is carried out using a charging roller of a contact type and in which toner deposition on the charging roller is prevented.

Another object of the present invention is to provide an image forming apparatus which has a charging roller for charging a photoconductor and in which toner deposition on the charging roller is prevented.

It is a further object of the present invention to provide a toner which is used in an image forming method using a charging roller of a contact type and which is free of a problem of toner deposition on the charging roller.

In accomplishing the foregoing object, there is provided in accordance with one aspect of the present invention an image forming method including charging a surface of a photoconductor by contact with a contact-type charging roller, exposing imagewise the charged surface to form an electrostatic latent image thereon, developing the latent image with a toner, transferring the developed image to a transfer member, and fixing the transferred image, wherein the charging roller has a surface roughness of 2–40 $\mu$m, and wherein the toner comprises a colorant, and a binder resin comprising a tetrahydrofuran-soluble component having such a molecular weight distribution that at least one peak having a half width not greater than 15,000 is present between 1,000 and 10,000 when measured by gel permeation chromatography.

In another aspect, the present invention provides an image forming apparatus comprising a photoconductor, a charging roller having a surface roughness of 2–40 $\mu$m and disposed for contacting with a surface of the photoconductor to charge the surface, exposing means for exposing imagewise the charged surface of the photoconductor to form an electrostatic latent image thereon, a developing device containing a toner for developing the latent image and to form a toner image on the photoconductor, means for transferring the toner image from the photoconductor to a transfer member, and a fixing device for fixing the transferred image to the transfer member, wherein the toner comprises a colorant, and a binder resin comprising a tetrahydrofuran-soluble component having such a molecular weight distribution that at least one peak having a half width not greater than 15,000 is present between 1,000 and 10,000 when measured by gel permeation chromatography.

The present invention also provides a toner for use in an image forming method which comprises charging a surface of a photoconductor by contact with a contact-type charging roller having a surface roughness of 2–40 $\mu$m, exposing imagewise the charged surface to form an electrostatic latent image thereon, developing the latent image with the toner, transferring the developed image to a transfer member, and fixing the transferred image, the toner comprising a colorant, and a binder resin comprising a tetrahydrofuran-soluble component having such a molecular weight distribution that at least one peak having a half width not greater than 15,000 is present between 1,000 and 10,000 when measured by gel permeation chromatography.

BRIEF DESCRIPTION OF THE DRAWING

Other objects, features and advantages of the present invention will become apparent from the detailed description of the preferred embodiments of the invention which follows, when considered in the light of the accompanying drawing in which the sole

DETAILED DESCRIPTION OF THE PREFERRED EMBODIMENTS OF THE INVENTION

Figure 1:
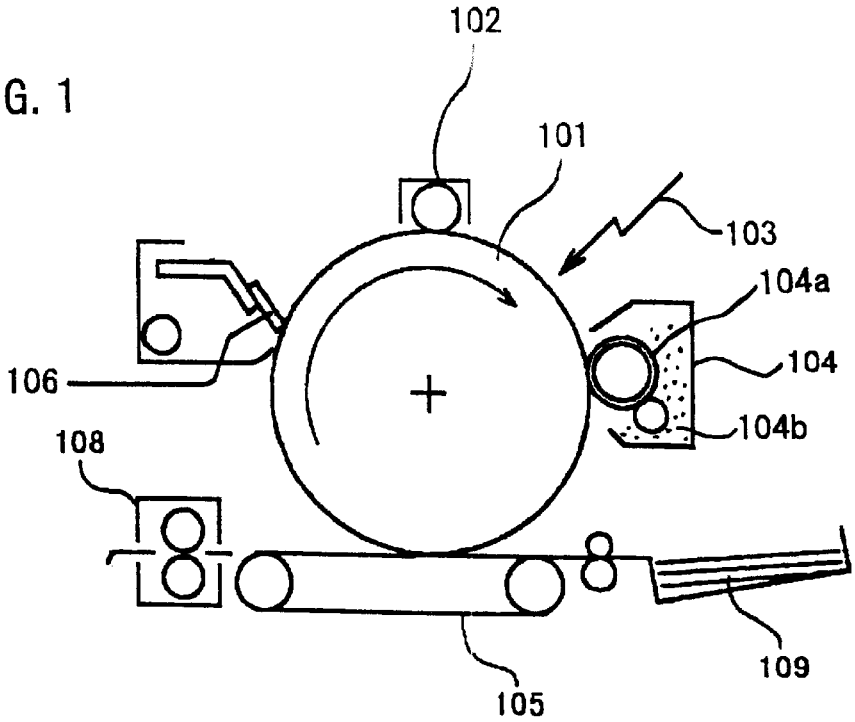
FIG. 1 is a schematic illustration of an image forming apparatus of the present invention.

It has been found that a surface roughness of a charging roller plays an important role in toner deposition thereon. It has also been found that when the charging roller has a surface roughness of 2–40 μm and when the toner contains a specific binder resin, the toner deposition on the charging roller can be effectively prevented, while ensuring desired charging efficiency. Any charging roller may be used for the purpose of the present invention as long as the surface roughness thereof is within the range of 2–40 μm. A surface roughness of more than 40 μm is undesirable because the charging efficiency is lowered. Too small a surface roughness below 2 μm is insufficient to prevent toner deposition onto the charging roll. Preferably the surface roughness of the charging roller is in the range of 5–25 μm.

As used herein, the term "surface roughness" is as measured using a contact surface roughness gauge (Surfcoder SE-3300, produced by Kosaka Laboratory Ltd., pickup: diamond PUDJ-2S) at a feeding speed of 0.1 mm/sec.

To prevent toner deposition to a surface of the charging roller, it is also important that the toner used for developing latent images should contain a binder resin containing a tetrahydrofuran (THF)-soluble component having such a molecular weight distribution that at least one peak is present between 1,000 and 10,000 when measured by gel permeation chromatography and that the one peak has a half width not greater than 15,000.

It is also preferred that more than 80% by weight of the THF-soluble component of the binder resin of the toner has a molecular weight of less than 100,000 when measured by gel permeation chromatography, for reasons of prevention of toner deposition on surfaces of the charging roller. Stated otherwise, that portion of the THF-soluble component which has a molecular weight of at least 100,000 when measured by gel permeation chromatography is preferably 20% by weight or less.

As used herein, the term "THF-soluble" is determined as follows: A sample resin is pressed at 150° C. and is placed in a cage made of 80 mesh metal net. The cage is immersed in toluene at 23° C. for 24 hours. The sample is then washed, dried and weighed to determine THF-insoluble, from which THF-soluble is determined.

The gel permeation chromatography is performed as follows: A column is stabilized in a chamber heated to 40° C., through which THF is flowed at a flowing speed of 1 ml/min. Then, 50 to 200 μl of a THF solution of a sample to be measured having a concentration of from 0.05 to 0.6% by weight, is injected into the column. Elution is then started to determine the molecular distribution of the sample. Similar operations are performed with respect to several standard polystyrene resins, which have different molecular weights and each of which has a single molecular weight, to prepare a calibration curve. It is preferable to use at least about ten standard polystyrenes to prepare the calibration curve. Polystyrenes having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ which are manufactured by Pressure Chemical Co., or Tosoh Corp. are exemplified as the standard polystyrenes. The measurement of molecular weight is effected under the following conditions:

Apparatus: HLC-802A, available from Tosoh Corp.

Detector: RI

Column: GMH×6, available from Tosoh Corp.

Solvent: THF

Flow rate: 1 ml/min.

Concentration of sample: 0.5% THF solution

Column temperature: 38° C.

The molecular weight of the sample is determined on the basis of the relationship between the logarithmic value and the count in the calibration curves of the standard.

It is preferred that the toner have a weight average particle diameter ranging from 6.0 to 10.5 μm and such a particle size distribution that 10–70% by number of the particles have a particle diameter of 5 μm or less for reasons of prevention of fouling of surfaces of the charging roller, especially when the toner has an external additive. When the toner has the above particle characteristics, release of the external additive such as an organic or inorganic powder from the toner can be effectively prevented so that fouling of surfaces of the charging roller by the external additive may be prevented.

The particle diameter distribution of the toner is measured with a Coulter Multisizer II (manufactured by Coulter Electronics, Inc.) to which an interface (manufactured by Nikkaki Inc.) capable of outputting number-based and volume-based distribution and a personal computer (PC9801 manufactured by NEC Inc.) are connected. As an electrolytic solution for measurement, an aqueous 1% by weight NaCl solution of first-grade sodium chloride is used. A dispersant (0.5–5 ml of a salt of alkylbenzenesulfonic acid) is added to 10 to 15 ml of the above electrolytic solution, to which 2 to 20 mg of a sample to be measured are added. The resulting mixture is subjected to a dispersing treatment for about 1-3 minute to about 3 minutes in an ultrasonic dispersing machine. The electrolytic solution (100–200 ml) is taken in another vessel, to which a predetermined amount of the dispersed sample is added. Using an aperture of 100 μm in the above particle size distribution measuring device, the particle size distribution is measured on the basis of the particle number with the Coulter counter for particles having a diameter in the range of 2–40 μm. The number and volume particle distribution are calculated. The weight average diameter of the toner is determined from that volume distribution. The median value of each channel is used as the representative of that channel.

It is also preferred that the toner have a glass transition temperature of 57–65° C. for reasons of prevention of toner deposition on surfaces of the charging roller. When the toner remaining on a photoconductor is brought into contact with the charging roller, heat is generated by abrasion between the charging roller and the photoconductor so that the binder resin may be melted or softened to cause deposition of the toner on the charging roller. By using the toner having a glass transition temperature of 57–65° C., such melting or softening of the binder resin is effectively prevented. The glass transition point is measured by the conventional DSC method.

The toner used in the present invention will be described in more detail below.

The toner includes a binder resin and a colorant. The binder resin is preferably at least one resin selected from styrene resins, acrylic resins and polyester resins for reasons of easiness of fabrication of the toner having the above-mentioned particle diameter characteristics and good charging characteristics.

The styrene resins are polymers or copolymers of a styrene-type monomer such as styrene, α-methylstyrene, vinyltoluene or chlorostyrene.

The acrylic resins are polymers or copolymers of acrylic or methacrylic monomer such as acrylic acid, methyl acrylate, ethyl acrylate, propyl acrylate, butyl acrylate, octyl acrylate, 2-ethylhexyl acrylate, n-tetradecyl acrylate, n-hexadecyl acrylate, lauryl acrylate, cyclohexyl acrylate, diethylaminoethyl acrylate, dimethylaminoethyl acrylate, methacrylic acid, methyl methacrylate, ethyl methacrylate, propyl methacrylate, butyl methacrylate, amyl methacrylate, hexyl methacrylate, 2-ethylhexyl acrylate, dodecyl methacrylate, lauryl acrylate, cyclohexyl acrylate, phenyl methacrylate, 2-hydroxyethyl methacrylate, 2-hydroxypropyl methacrylate, dimethylaminoethyl acrylate, glycidyl methacrylate or stearyl methacrylate.

As a comonomer for the styrene or acrylic resins, there may be mentioned acrylonitrile, 2-vinylpyridine, vinyl carbazole, vinyl methyl ether, butadiene, isoprene, maleic anhydride, maleic acid, a maleic acid monoester, a maleic acid diester or a vinyl acetate.

The above styrene and acrylic resins may be crosslinked with a difunctional or polyfunctional crosslinking agent. Illustrative of suitable difunctional crosslinking agents are divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene glycol (#200, #400 or #600) diacrylate, dipropylene glycol diacrylate, polypropylene glycol diacrylate, polyester-type diacrylate (MANDA manufactured by Nihon Kayaku K. K.), ethylene glycol dimethacrylate, 1,3-butylene glycol dimethacrylate, 1,4-butanediol dimethacrylate, 1,5-pentanediol dimethacrylate, 1,6-hexanediol dimethacrylate, neopentyl glycol dimethacrylate, diethylene glycol dimethacrylate, triethylene glycol diacrylate, tetraethylene glycol dimethacrylate, polyethylene glycol (#200, #400 or #600) dimethacrylate, dipropylene glycol dimethacrylate, polypropylene glycol dimethacrylate and polyester-type dimethacrylate (MANDA manufactured by Nihon Kayaku K. K.).

Illustrative of suitable polyfunctional crosslinking agents are pentaerythritol triacrylate, trimethylolethane triacrylate, trimethylolpropane triacrylate, tetramethylolmethane tetracrylate, oligoester acrylate, pentaerythritol trimethacrylate, trimethylolethane trimethacrylate, trimethylolpropane trimethacrylate, tetramethylolmethane tetramethacrylate, oligoester methacrylate, 2,2-bis(4-methacryloxypolyethoxyphenyl)-propane, diallyl phthalate, triallyl cyanurate, triallyl isocyanurate, triallyl trimellitate and diaryl chlorendate.

Suitable polyester resins for use as the binder resin include known polyester resins which can be prepared by condensation polymerization of one or more alcohols and one or more carboxylic acids or their derivatives.

Specific examples of the alcohols include dihydric alcohols such as ethylene glycol, diethylene glycol, triethylene glycol 1,2-propylene glycol, 1,3-propylene glycol, 1,4-butanediol, neopentane glycol and cyclohexane dimethanol; and bisphenols such as hydrogenated bisphenol A, polyoxyealkylene adducts (e.g. polyoxyethylene adducts and polyoxypropylene adducts) of bisphenol A.

Specific examples of the carboxylic acids include dibasic acids such as malonic acid, succinic acid, an alkyl succinic acid, glutaric acid, adipic acid, pimelic acid, suberic acid, azelaic acid, sebacic acid, maleic acid, fumaric acid, mesaconic acid, citraconic acid, hexanedicarboxylic acid, itaconic acid, glutaconic acid, isophthalic acid, terephthalic acid and phthalic acid. Acid anhydrides, alkyl esters, acid halides and other reactive derivatives of the above carboxylic acids may be also used.

For the purpose of forming non-linear chains, polyhydric alcohols having three or more hydroxyl groups and/or polycarboxylic acids having three of more carboxylic groups may be additionally used in an amount so that the formation of tetrahydrofuran-insolubles is minimized. Examples of such polyhydric alcohols include sorbitol, 1,2,3,6-hexanetetraol, 1,4-sorbitan, pentaerythritol, 1,2,4-butanetriol, 1,2,5-pentanetriol, glycerin, 2-methylpropanetriol, 2-methyl-1,2,4-butanetriol, trimethylolethane, trimethylolpropane and 1,3,5-trimethylolbenzene. Examples of such polycarboxylic acids include 1,2,4-butanetricarboxylic acid, 1,2,4-cyclohexanetricarboxylic acid, 1,2,4-benzenetricarboxylic acid, 1,2,5-benzenetricarboxylic acid, 2,5,7-naphthalenetricarboxylic acid and pyromellitic acid.

Specific examples of suitable polyester resins for use as a binder resin for the toner include polyesters obtained by condensation polymerization of an aromatic polycarboxylic acid and a bisphenol A-containing polyhydric alcohol, such as a linear polyester of terephthalic acid/bisphenol A ethylene oxide additive/1,4-cyclohexanedimethanol.

Suitable materials for use as the colorant in the toner of the present invention include known pigments and dyes. Examples of the pigments and dyes include carbon black, Nigrosine dyes, lamp black, Sudan Black SM, Fast Yellow G. Benzidine Yellow, Pigment Yellow, Indian First Orange, Irgazine Red, Para Nitraniline Red, Toluidine Red, Carmine FB, Permanent Bordeaux FRR, Pigment Orange R, Lithol Red 2G, Lake Red 2G, Rhodamine FB, Rhodamine B Lake, Methyl Violet B lake, Phthalocyanine Blue, Pigment Blue, Brilliant Green B, Phthalocyanine Green, Oil Yellow GG, Zapon First Yellow CGG, Kayaset Y963, Kayaset YG, Zapon First Orange RR, Oil Scarlet, Aurazole Brown B, Zapon First Scarlet CG, Aizen Spiron Red BEH and Oil Pink OP. These pigments and dyes are used alone or in combination. The concentration of the colorant in the toner is from 1 to 30% by weight, and preferably from 5 to 20% by weight based on the binder resin.

The toner of the present invention may be a magnetic toner which includes a magnetic material. Suitable magnetic materials for use in the toner include ferromagnetic substances such as ferrite, magnetite, iron, nickel and cobalt, alloys thereof and compounds containing the above-mentioned elements; alloys which are not contain the above-mentioned ferromagnetic elements, but are capable of exhibiting the ferromagnetism by subjecting to proper heat treatment, for example, the Heusler's alloys such as an alloy of manganese, copper and aluminum, and an alloy of manganese, copper and tin; and chromium dioxide. These magnetic materials may also serve to function as a colorant.

It is preferable that the amount of magnetic substance be in the range of 30 to 150 parts by weight, more preferably in the range of 40 to 100 parts by weight, per 100 parts by weight of the binder resin. The toner may contain a positive or negative charge controlling agent. Examples of the positive charge controlling agent for use in the present invention are as follows: Nigrosine; azine dyes with an alkyl group having 2 to 16 carbon atoms as disclosed in Japanese Patent Publication No. 42-1627; basic dyes such as C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green. 1 (C.I. 42040), C.I. Basic Green 4 (C.I. 42000); lake pigments of the above basic dyes (lake agent may be, for example, phosphorus tungstate, phosphorus molibdate, phosphorus tungstate molibdate, tannic acid, lauric acid, gallic acid, ferricyanates or ferrocyaniates); C.I. Solvent Black 3 (C.I. 26150), Hanza Yellow G (C. I. 11680), C. I. Mordlant Black 11, C. I. Pigment Black 1; quaternary ammonium salts such as benzoylmethyl-hexadecylammonium chloride and decyl trimethyl chloride; polyamide resins such as amino-group-containing vinyl polymers and amino-group-containing condensation polymers. Preferred examples include nigrosine, quaternary ammonium salts, triphenylmethane-type nitrogen-containing compounds, and polyamides.

Examples of negative charge controlling agent include metal complex salts of monoazo dyes as described in Japanese Patent Publications Nos. 41-20153, 43-27596, 44-6397 and 45-26478; nitroamine acid, its salt and dyes or pigments such as C.I. 4645 as disclosed in Japanese Laid-Open Patent Publication No. 50-133338; complexes of metals, such as Zn, Al, Co, Cr and Fe with salicylic acid, naphthoic acid and dicarboxylic acid as disclosed in Japanese Patent Publications Nos. 55-42752, 58-41508, 58-7348 and 59-7385; sulfonated copper phthalocyanine pigment, nitro- or halogen-introduced styrene oligomers, and chlorinated paraffin. Above all, metal complexes of salicyclic acid, metal complexes of naphthoic acids, metal complexes of dicarboxylic acid, and metal complexes of derivative of there acids are especially preferably used.

The charge control agent may preferably be used in an amount of 0.1–3 parts by weight per 100 parts by weight of the binder resin so as to retain a good triboelectric chargeability while minimizing adverse effects thereof, such as fouling of the developing sleeve surface leading to a lower developing performance and a lower environmental stability.

The binder resin may be used in combination with an olefin polymer or copolymer as a fixation aid. Illustrative of suitable olefin polymers and copolymers are polyethylene, polypropylene, ethylene-propylene copolymers, ethylene-vinyl acetate copolymers, ethylene-ethyl acrylate copolymers and ionomers having a polyethylene skeleton. The olefin monomer content of the copolymers is preferably at least 50 mole %, more preferably at least 60 mole %.

The toner can be employed as a developing agent as it is, but its characteristics such as fluidity and charge characteristics may be improved by adding an external additive such as inorganic oxide microparticles, organic polymer microparticles to surfaces of the toner particles. Examples of the external additive include silica, titanium oxide, aluminum oxide, vinyl (co)polymer and the like. These external additives are preferably added in an amount within the range of about 0.05–5% by weight based on the toner particles.

In the case where the toner is used as a two-component developer, the toner is used in combination with a carrier. Any conventionally employed carrier, such as iron powder, ferrite powder, magnetite powder, nickel powder, glass beads, which may be coated with a resin or the like, may be suitably used.

One embodiment of the image forming method according to the present invention will be described with reference to FIG. 1 which shows an electrophotographic apparatus usable as a copying machine or a printer for practicing the image forming method according to the present invention.

Designated as 101 is a photoconductor (e.g., an OPC photosensitive drum, an amorphous silicon photosensitive drum or a polysilicon photosensitive drum). A contact-type charging roller 102 is disposed for rolling contact with the photoconductor 101 to charge a surface thereof by applying a bias voltage. By using the contact-type charging roller, the problem of generation of ozone in the charging step using conventional corona discharge can be overcome and an activated carbon filter used for removing ozone is no necessary in the present invention.

An exposure means including a light source 103 (e.g., laser light or light from a halogen lamp) is provided to irradiate the charged surface of the photoconductor 101 and to form an electrostatic latent image thereon.

Disposed downstream of the exposure means is a developing sleeve 104*a* to which a toner 104*b* contained in a vessel 104 is applied to develop the electrostatic latent image to form a toner image on the photoconductor 63. In an image forming apparatus other than the one shown in FIG. 1, it is possible to use a developing means including a two-component type developer comprising a toner and a carrier. The image development may be carried out by a magnetic brush method, a cascade method, a powder cloud method, a method using a magnetic toner (as disclosed in U.S. Pat. No. 3,909,258) or a method using a high resistivity magnetic toner (as disclosed in Japanese Laid Open Publication No. 53-31136).

A transfer station including a transfer means 105 (e.g. a transfer belt as shown or transfer roller) is provided downstream of the developing section to electrostatically transfer the toner image on the photoconductor 101 onto a transfer material 109 such as paper which has been fed to the transfer station by feed rollers. As the case may be, the toner image on the photoconductor 101 can be transferred onto an intermediate transfer member (not shown, such as an intermediate transfer drum or an intermediate transfer belt) and then to the transfer material P. The image transfer may be carried out by using a corona transfer method or a method in which a bias voltage is applied to a transfer belt or drum which is brought into contact with the photoconductor 101.

The toner image on the transfer material 109 separated from the photoconductor 101 may be fixed thereto by a fixing means 108. The fixation of the toner image may be carried out by a heat-pressure roller fixing means as shown or a flush heat fixing means.

A portion, if any, of the toner remaining on the photoconductor 101 after the transfer step may be removed, as desired, from the surface of the photoconductor 101 by a cleaning means 106 (e.g., a cleaning blade as shown, a cleaning roller or a fur brush). The photosensitive member after the cleaning is again subjected to an image forming cycle as described above starting from the charging step by the charging roller 102.

The following examples will further illustrate the present invention. Parts and percentages are by weight except otherwise specifically noted.

EXAMPLE 1

Alcohol components (a mixture of 60 parts of terephthalic acid, 25 parts of dodecenyl succinic anhydride and 15 parts of trimellitic anhydride) and carboxylic acid components (a mixture of 70 parts of bisphenol A(2,2)propylene oxide and 50 parts of bisphenol A (2,2)ethylene oxide) were placed in a four-necked, 1 liter round bottom flask equipped with a thermometer, a stirrer, a condenser and a nitrogen gas feed pipe. The contents in the flask were heated to 200° C. under the nitrogen gas atmosphere, to which 0.05 g of dibutyl tin oxide were added. The mixture was maintained at 200° C. to obtain Polyester A.

The following components were mixed using a Henschel mixer.

| | |
|---|---|
| Polyester resin A | 100 |
| Low molecular weight polypropylene (tradename: Viscol 550 P, manufactured by Sanyo Chemical Industries Ltd.) | 5 |
| Carbon black (tradenamed as #44, manufactured by Mitsubishi Chemical Corp.) | 13 |
| Cr-containing Azo compound | 2 |

The mixture was then melted and kneaded using a single axis extruder. The extruded mass was cooled and coarsely pulverized with a hammer mill into about 1–2 nm. Subsequently, fine pulverization was carried out by an air jet method. The finely pulverized mass was classified with a classifier to remove both excessively fine and coarse particles. The remaining product (100 parts) was mixed with 0.5 part of titanium oxide using a Henschel mixer to obtain a toner whose properties were as shown below:

| | |
|---|---|
| Weight average particle diameter: | 8.93 μm |
| Content of particles with particle diameter of 5 μm or less: | 35% by number |
| Main peak of molecular distribution of THF soluble component determined by GPC (binder resin) | 8,000 |
| Half width of the main peak of molecular distribution | 11,000 |
| Tg (glass transition temperature) | 61° C. |

The thus obtained toner was mixed with a ferrite carrier to obtain a two-component type developer. The developer showed an amount of triboelectric charge of −25.3 μC/g. The developer was charged in an image forming apparatus (Imagio 450 manufactured by Ricoh Company, Ltd.) modified by incorporating a hydrin rubber charging roller having a surface roughness of 10 μm thereinto. An image having an image density of 1.43 was able to be obtained initially. After production of 300,000 sheets, the amount of triboelectric charge and the image density were measured. It was found that the triboelectric charge was −23.2 μC/g and the image density was 1.40. Thus, a reduction of image density which might be caused by toner deposition on the charging roller did not occur. When the charging roller was checked with naked eyes, no fouling was observed at all.

Comparative Example 1

Example 1 was repeated in the same manner as described except that the charging roller had a surface roughness of 0.2 μm. When the image formation was conducted to obtain 1,000 sheets, toner deposition on the charging roller began occurring. When 7,000 sheets were produced, the image density was found to decrease to 0.72.

Comparative Example 2

Example 1 was repeated in the same manner as described except that the charging roller had a surface roughness of 55 μm. The image density of the initially produced sheet was only 0.45.

Comparative Example 3

Example 1 was repeated in the same manner as described except that the polymerization time and temperature in the preparation of Polyester A were changed. The resulting toner had the following properties:

| | |
|---|---|
| Weight average particle diameter: | 9.1 μm |
| Content of particles with particle diameter of 5 μm or less: | 32% by number |
| Main peak of molecular distribution of THF soluble component determined by GPC (binder resin) | 9,000 |
| Half width of the main peak of molecular distribution | 18,000 |
| Tg (glass transition temperature) | 60° C. |

When the image formation was conducted to obtain 10,000 sheets, toner deposition on the charging roller began occurring and the image density was found to decrease to 0.55.

Comparative Example 4

Example 1 was repeated in the same manner as described except that the polymerization time and temperature in the preparation of Polyester A were changed. The resulting toner had the following properties:

| | |
|---|---|
| Weight average particle diameter: | 8.8 μm |
| Content of particles with particle diameter of 5 μm or less: | 40% by number |
| Main peak of molecular distribution of THF soluble component determined by GPC (binder resin) | 7,000 |
| Half width of the main peak of molecular distribution | 20,000 |
| Tg (glass transition temperature) | 59° C. |

When the image formation was conducted to obtain 10,000 sheets, toner deposition on the charging roller began occurring and the image density was found to decrease to 0.65.

EXAMPLE 2

Example 1 was repeated in the same manner as described except that Polyester A was replaced by styrene-butyl acrylate copolymer (weight ratio of the styrene monomer to the butyl acrylate monomer was 65:35) having a weight average molecular weight of 200,000 and an acid value of 20. The toner had the following properties:

| | |
|---|---|
| Weight average particle diameter: | 9.1 μm |
| Content of particles with particle diameter of 5 μm or less: | 32% by number |
| Main peak of molecular distribution of THF soluble component determined by GPC (binder resin) | 9,000 |

-continued

| | |
|---|---|
| Half width of the main peak of molecular distribution | 10,000 |
| Tg (glass transition temperature) | 60° C. |

The thus obtained toner was mixed with a ferrite carrier to obtain a two-component type developer. The developer showed an amount of triboelectric charge of −28.1 μC/g. The developer was charged in an image forming apparatus (Imagio 450 manufactured by Ricoh Company, Ltd.) modified by incorporating a hydrin rubber charging roller having a surface roughness of 20 μm thereinto. An image having an image density of 1.43 was able to be obtained initially. After production of 300,000 sheets, the amount of triboelectric charge and the image density were measured. It was found that the triboelectric charge was −27.32 μC/g and the image density was 1.47. Thus, a reduction of image density which might be caused by toner deposition on the charging roller did not occur. When the charging roller was checked with naked eyes, no fouling was observed at all.

EXAMPLE 3

Alcohol components (a mixture of 67 parts of terephthalic acid, 25 parts of dodecenyl succinic anhydride and 8 parts of trimellitic anhydride) and carboxylic acid components (a mixture of 70 parts of bisphenol A(2,2)propylene oxide and 50 parts of bisphenol A(2,2)ethylene oxide) were placed in a four-necked, 2 liter round bottom flask equipped with a thermometer, a stainless steel stirrer, a condenser and a nitrogen gas feed pipe. The contents in the flask were heated to 170° C. for 5 hours with stirring under the nitrogen gas atmosphere. The reaction was further continued at 210° C. until no change was observed in the softening point as measured in accordance with ASTM E28-51T. Then, 108 g of 1,2,4-benzenetricarboxylic anhydride was added to the reaction mixture and the reaction was continued at 210° C., while monitoring the softening point as measured in accordance with ASTM E28-51T, until a predetermined softening point was reached. The reaction mixture was cooled to room temperature to obtain Polyester B.

Using the thus obtained Polyester resin B, toner was prepared in the same manner as that of Example 1. The resulting toner had the following properties:

| | |
|---|---|
| Weight average particle diameter: | 6.4 μm |
| Content of particles with particle diameter of 5 μm or less: | 70% by number |
| Main peak of molecular distribution of THF soluble component determined by GPC (binder resin) | 8,500 |
| Half width of the main peak of molecular distribution | 9,000 |
| Tg (glass transition temperature) | 61.5° C. |

The thus obtained toner was mixed with a ferrite carrier to obtain a two-component type developer. The developer showed an amount of triboelectric charge of −29.1 μC/g. The developer was charged in an image forming apparatus (Imagio 450 manufactured by Ricoh Company, Ltd.) modified by incorporating a hydrin rubber charging roller having a surface roughness of 20 μm thereinto. An image having an image density of 1.46 was able to be obtained initially. After production of 300,000 sheets, the amount of triboelectric charge and the image density were measured. It was found that the triboelectric charge was −29.1 μC/g and the image density was 1.44. Thus, a reduction of image density which might be caused by toner deposition on the charging roller did not occur. When the charging roller was checked with naked eyes, no fouling was observed at all.

EXAMPLE 4

Example 3 was repeated in the same manner as described except that the monomer composition was changed. The resulting toner had Tg of 55° C. No reduction of image density was observed even after production of 300,000 copies. When the charging roller was checked with naked eyes, however, slight fouling was observed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Application No. 2001-043587, filed Feb. 20, 2001, inclusive of the specification and claims, are hereby incorporated by reference herein.

What is claimed is:

1. An image forming method comprising charging a surface of a photoconductor by contact with a contact-type charging roller, exposing imagewise the charged surface to form an electrostatic latent image thereon, developing the latent image with a toner, transferring the developed image to a transfer member, and fixing the transferred image, wherein said charging roller has a surface roughness of 2–40 μm, and wherein said toner comprises a colorant, and a binder resin comprising a tetrahydrofuran-soluble component having such a molecular weight distribution that at least one peak having a half width not greater than 15,000 is present between 1,000 and 10,000 when measured by gel permeation chromatography.

2. The method according to claim 1, wherein said toner has a weight average particle diameter ranging from 6.0 to 10.5 μm and such a particle size distribution that 10–70% by number of the particles have a particle diameter of 5 μm or less.

3. The method according to claim 1, wherein said toner has a glass transition temperature of 57–65° C.

4. The method according to claim 1, wherein said binder resin comprises at least one resin selected from the group consisting of styrene resins, acrylic resins and polyester resins.

5. The method according to claim 1, wherein that portion of said tetrahydrofuran-soluble component which has a molecular weight of at least 100,000 when measured by gel permeation chromatography is 20% by weight or less.

6. An image forming apparatus comprising a photoconductor, a charging roller having a surface roughness of 2–40 μm and disposed for contacting with a surface of said photoconductor to charge said surface, exposing means for exposing imagewise the charged surface of said photoconductor to form an electrostatic latent image thereon, a developing device containing a toner for developing the latent image and to form a toner image on said photoconductor, means for transferring the toner image from said photoconductor to a transfer member, and a fixing device for fixing the transferred image to the transfer member, wherein said toner comprises a colorant, and a binder resin comprising a tetrahydrofuran-soluble component having such a molecular weight distribution that at least one peak having a half width not greater than 15,000 is present between 1,000 and 10,000 when measured by gel permeation chromatography.

7. The apparatus according to claim 6, wherein said toner has a weight average particle diameter ranging from 6.0 to 10.5 μm and such a particle size distribution that 10–70% by number of the particles have a particle diameter of 5 μm or less.

8. The apparatus according to claim 6, wherein said toner has a glass transition temperature of 57–65° C.

9. The apparatus according to claim 6, wherein said binder resin comprises at least one resin selected from the group consisting of styrene resins, acrylic resins and polyester resins.

10. The apparatus according to claim 6, wherein that portion of said tetrahydrofuran-soluble component which has a molecular weight of at least 100,000 when measured by gel permeation chromatography is 20% by weight or less.

11. A toner for use in an image forming method which comprises charging a surface of a photoconductor by contact with a contact-type charging roller having a surface roughness of 2–40 μm, exposing imagewise the charged surface to form an electrostatic latent image thereon, developing the latent image with said toner, transferring the developed image to a transfer member, and fixing the transferred image, said toner comprising a colorant, and a binder resin comprising a tetrahydrofuran-soluble component having such a molecular weight distribution that at least one peak having a half width not greater than 15,000 is present between 1,000 and 10,000 when measured by gel permeation chromatography.

12. The method according to claim 1, wherein the binder resin is a styrene polymer or copolymer comprising one or more polymerized monomer units selected from the group consisting of styrene, α-methylstyrene, vinyltoluene, chlorostyrene, and combinations thereof.

13. The method according to claim 1, wherein the binder resin is an acrylic or methacrylic polymer or copolymer comprising one or more polymerized monomer units selected from the group consisting of acrylic acid, methyl acrylate, ethyl acrylate, propyl acrylate, butyl acrylate, octyl acrylate, 2-ethylhexyl acrylate, n-tetradecyl acrylate, n-hexadecyl acrylate, lauryl acrylate, cyclohexyl acrylate, diethylaminoethyl acrylate, dimethylaminoethyl acrylate, methacrylic acid, methyl methacrylate, ethyl methacrylate, propyl methacrylate, butyl methacrylate, amyl methacrylate, hexyl methacrylate, 2-ethylhexyl acrylate, dodecyl methacrylate, lauryl acrylate, cyclohexyl acrylate, phenyl methacrylate, 2-hydroxyethyl methacrylate, 2-hydroxypropyl methacrylate, dimethylaminoethyl acrylate, glycidyl methacrylate, stearyl methacrylate, and combinations thereof.

14. The method according to claim 1, wherein the binder resin is a styrene or acrylic resin, which further comprises one or more polymerized comonomer units selected from the group consisting of acrylonitrile, 2-vinylpyridine, vinyl carbazole, vinyl methyl ether, butadiene, isoprene, maleic anhydride, maleic acid, maleic acid monoester, maleic acid diester, vinyl acetate, and combinations thereof.

15. The method according to claim 1, wherein the binder resin is a polyester resin prepared by condensation polymerization of at least one alcohol with at least one carboxylic acid, wherein the alcohol is selected from the group consisting of dihydric alcohol, ethylene glycol, diethylene glycol, triethylene glycol 1,2-propylene glycol, 1,3-propylene glycol, 1,4-butanediol, neopentane glycol, cyclohexane dimethanol, bisphenols, hydrogenated bisphenol A, polyoxyethylene adduct of bisphenol A, polyoxypropylene adduct of bisphenol A, polyhydric alcohol having three or more hydroxyl groups, sorbitol, 1,2,3,6-hexanetetraol, 1,4-sorbitan, pentaerythritol, 1,2,4-butanetriol, 1,2,5-pentanetriol, glycerin, 2-methylpropanetriol, 2-methyl-1,2,4-butanetriol, trimethylolethane, trimethylolpropane, 1,3,5-trimethylolbenzene, and combinations thereof;

and wherein the carboxylic acid is selected from the group consisting of dibasic acid, malonic acid, succinic acid, an alkyl succinic acid, glutaric acid, adipic acid, pimelic acid, suberic acid, azelaic acid, sebacic acid, maleic acid, fumaric acid, mesaconic acid, citraconic acid, hexanedicarboxylic acid, itaconic acid, glutaconic acid, isophthalic acid, terephthalic acid, phthalic acid, acid anhydrides thereof, alkyl esters thereof, acid halides thereof, polycarboxylic acid having three of more carboxylic groups, 1,2,4-butanetricarboxylic acid, 1,2,4-cyclohexanetricarboxylic acid, 1,2,4-benzenetricarboxylic acid, 1,2,5-benzenetricarboxylic acid, 2,5,7-naphthalenetricarboxylic acid, pyromellitic acid, and combinations thereof.

16. The apparatus according to claim 6, wherein the binder resin is a styrene polymer or copolymer comprising one or more polymerized monomer units selected from the group consisting of styrene, α-methylstyrene, vinyltoluene, chlorostyrene, and combinations thereof.

17. The apparatus according to claim 6, wherein the binder resin is an acrylic or methacrylic polymer or copolymer comprising one or more polymerized monomer units selected from the group consisting of acrylic acid, methyl acrylate, ethyl acrylate, propyl acrylate, butyl acrylate, octyl acrylate, 2-ethylhexyl acrylate, n-tetradecyl acrylate, n-hexadecyl acrylate, lauryl acrylate, cyclohexyl acrylate, diethylaminoethyl acrylate, dimethylaminoethyl acrylate, methacrylic acid, methyl methacrylate, ethyl methacrylate, propyl methacrylate, butyl methacrylate, amyl methacrylate, hexyl methacrylate, 2-ethylhexyl acrylate, dodecyl methacrylate, lauryl acrylate, cyclohexyl acrylate, phenyl methacrylate, 2-hydroxyethyl methacrylate, 2-hydroxypropyl methacrylate, dimethylaminoethyl acrylate, glycidyl methacrylate, stearyl methacrylate, and combinations thereof.

18. The apparatus according to claim 6, wherein the binder resin is a styrene or acrylic resin, which further comprises one or more polymerized comonomer units selected from the group consisting of acrylonitrile, 2-vinylpyridine, vinyl carbazole, vinyl methyl ether, butadiene, isoprene, maleic anhydride, maleic acid, maleic acid monoester, maleic acid diester, vinyl acetate, and combinations thereof.

19. The apparatus according to claim 6, wherein the binder resin is a polyester resin prepared by condensation polymerization of at least one alcohol with at least one carboxylic acid, wherein the alcohol is selected from the group consisting of dihydric alcohol, ethylene glycol, diethylene glycol, triethylene glycol 1,2-propylene glycol, 1,3-propylene glycol, 1,4-butanediol, neopentane glycol, cyclohexane dimethanol, bisphenols, hydrogenated bisphenol A, polyoxyethylene adduct of bisphenol A, polyoxypropylene adduct of bisphenol A, polyhydric alcohol having three or more hydroxyl groups, sorbitol, 1,2,3,6-hexanetetraol, 1,4-sorbitan, pentaerythritol, 1,2,4-butanetriol, 1,2,5-pentanetriol, glycerin, 2-methylpropanetriol, 2-methyl-1,2,4-butanetriol, trimethylolethane, trimethylolpropane, 1,3,5-trimethylolbenzene, and combinations thereof;

and wherein the carboxylic acid is selected from the group consisting of dibasic acid, malonic acid, succinic acid, an alkyl succinic acid, glutaric acid, adipic acid, pimelic acid, suberic acid, azelaic acid, sebacic acid, maleic acid, fumaric acid, mesaconic acid, citraconic acid, hexanedicarboxylic acid, itaconic acid, glutaconic acid, isophthalic acid, terephthalic acid, phthalic acid, acid anhydrides thereof, alkyl esters thereof, acid halides thereof, polycarboxylic acid having three of more carboxylic groups, 1,2,4-butanetricarboxylic acid, 1,2,4-cyclohexanetricarboxylic acid, 1,2,4-benzenetricarboxylic acid, 1,2,5-benzenetricarboxylic acid, 2,5,7-naphthalenetricarboxylic acid, pyromellitic acid, and combinations thereof.

* * * * *